US007351122B2

(12) United States Patent
Suemitsu et al.

(10) Patent No.: US 7,351,122 B2
(45) Date of Patent: Apr. 1, 2008

(54) RECEPTACLE TERMINAL

(76) Inventors: Yoshifumi Suemitsu, c/o Tyco Electronics Amp K.K. 3-5-8 Hisamoto, Takatsu-ku, Kawasaki-shi, Kanagawa-ken, 213-8535 (JP); Kazushige Sakamaki, c/o Tyco Electronics Amp K.K. 3-5-8 Hisamoto, Takatsu-ku, Kawasaki-shi, Kanagawa-ken, 213-8535 (JP); Hiroshi Kobayashi, c/o Toyota Jidosha Kabushiki Kaisha 1, Toyota-cho, Toyota-shi, Aichi-ken, 471-8571 (JP); Masato Minakata, c/o Toyota Jidosha Kabushiki Kaisha 1, Toyota-cho, Toyota-shi, Aichi-ken, 471-8571 (JP); Atsushi Nishida, c/o Toyota Jidosha Kabushiki Kaisha 1, Toyota-cho, Toyota-shi, Aichi-ken, 471-8571 (JP)

( * ) Notice: Subject to any disclaimer, the term of this patent is extended or adjusted under 35 U.S.C. 154(b) by 0 days.

(21) Appl. No.: 11/180,748

(22) Filed: Jul. 12, 2005

(65) Prior Publication Data

US 2006/0035538 A1 Feb. 16, 2006

(30) Foreign Application Priority Data

Jul. 12, 2004 (JP) ..... 2004-205021
Apr. 22, 2005 (JP) ..... 2005-124546

(51) Int. Cl.
*H01R 11/22* (2006.01)

(52) U.S. Cl. ..... 439/852

(58) Field of Classification Search ..... 439/851–857, 439/843, 845, 381, 848, 81, 861–862, 842, 439/82, 839, 867
See application file for complete search history.

(56) References Cited

U.S. PATENT DOCUMENTS 4,907,990 A * 3/1990 Bertho et al. ..... 439/851

(Continued)

FOREIGN PATENT DOCUMENTS

JP 3-502622 6/1991

(Continued)

OTHER PUBLICATIONS

European Search Report dated Oct. 31, 2005 for Application No. EP 05 10 6327.

*Primary Examiner*—Edwin A. Leon
(74) *Attorney, Agent, or Firm*—Barley Snyder LLC

(57) ABSTRACT

A receptacle terminal includes a contact section. The contact section includes a substantially L-shaped contact spring, a first protection member, and a second protection member. The contact spring includes a link arm and a contact arm. The link arm has a first edge and a second edge opposite the first edge. The first edge extends in a mating direction of a mating terminal. The contact arm extends along the first edge and has a tip end portion connected to the first edge. The first protection member has a first link arm protection member opposing the second edge. The second protection member has a second link arm protection member opposing the first edge. The receptacle terminal thereby ensures protection of the contact spring and necessary contact pressure between the receptacle terminal and a mating terminal while having a small external size.

20 Claims, 8 Drawing Sheets

U.S. PATENT DOCUMENTS

| | | | | | |
|---|---|---|---|---|---|
| 4,934,965 | A | | 6/1990 | Buddrus et al. | 439/845 |
| 5,188,545 | A | * | 2/1993 | Hass et al. | 439/851 |
| 5,338,229 | A | * | 8/1994 | Egenolf | 439/839 |
| 5,681,190 | A | * | 10/1997 | Childs | 439/856 |
| 5,833,500 | A | * | 11/1998 | Mahon et al. | 439/852 |
| 5,951,339 | A | * | 9/1999 | Chaillot et al. | 439/852 |
| 6,010,377 | A | * | 1/2000 | Dechelette et al. | 439/851 |
| 6,305,992 | B1 | | 10/2001 | Bouda et al. | 439/834 |

FOREIGN PATENT DOCUMENTS

| | | |
|---|---|---|
| WO | WO 89/05531 | 6/1989 |

* cited by examiner

RECEPTACLE TERMINAL

FIELD OF THE INVENTION

The invention relates to a receptacle terminal comprising a contact spring and first and second protection members for protecting the same.

BACKGROUND OF THE INVENTION

International Publication No. WO 89/05531 teaches a receptacle terminal comprising a substantially rectangular contact section. The contact section is formed from a metal plate to have opposing first and second contact springs that extend at approximate right angles to each other. The first and second contact springs each have an L-shaped cross-section. The first and second contact springs apply pressure to a mating terminal to ensure contact pressure between the receptacle terminal and the mating terminal. The receptacle terminal includes a protection member for protecting the first and second contact springs. The protection member, however, disadvantageously increases the external size of the receptacle terminal.

SUMMARY OF THE INVENTION

It is therefore an object of the invention to provide a receptacle terminal in which a contact spring is protected and necessary contact pressure is ensured between the receptacle terminal and a mating terminal while an external size of the receptacle terminal remains small.

This and other objects are achieved by a contact section for a receptacle terminal comprising a substantially L-shaped contact spring, a first protection member, and a second protection member. The contact spring includes a link arm and a contact arm. The link arm has a first edge and a second edge opposite the first edge. The first edge extends in a mating direction of a mating terminal. The contact arm extends along the first edge and has a tip end portion connected to the first edge. The contact arm includes a contact member for contacting the mating terminal. The first protection member has a first link arm protection member opposing the second edge. The second protection member has a second link arm protection member opposing the first edge.

This and other objects are further achieved by a receptacle terminal comprising a crimp section a contact section. The contact section includes a substantially L-shaped contact spring, a first protection member, and a second protection member. The contact spring includes a link arm and a contact arm. The link arm has a first edge and a second edge opposite the first edge. The first edge extends in a mating direction of a mating terminal. The contact arm extends along the first edge and has a tip end portion connected to the first edge. The first protection member has a first link arm protection member opposing the second edge. The second protection member has a second link arm protection member opposing the first edge.

DETAILED DESCRIPTION OF THE INVENTION

Figure 1:
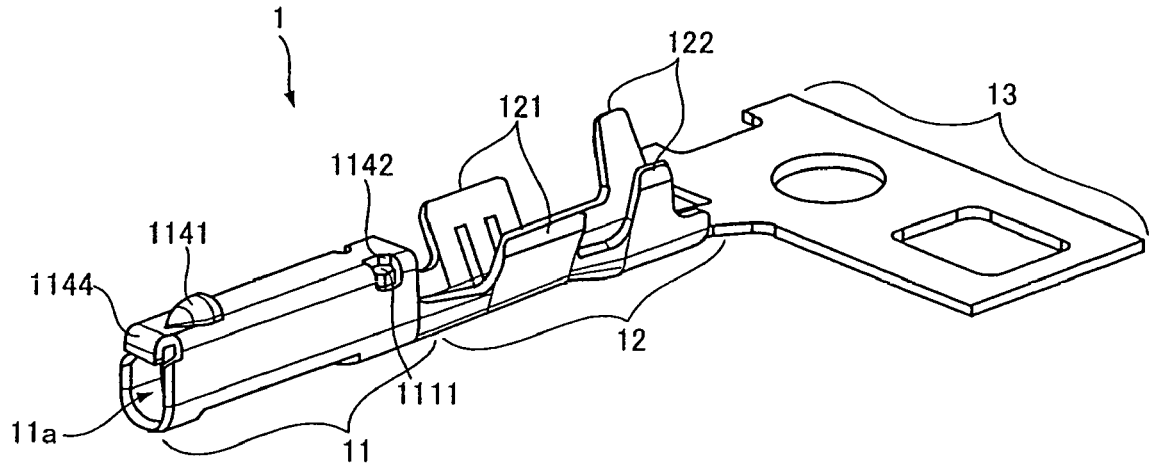
FIG. 1 is a perspective view from above of a first embodiment of a receptacle terminal according to the invention.

FIGS. 1-4B show a receptacle terminal 1 according to a first embodiment of the invention. As shown in FIG. 1, the receptacle terminal 1 comprises a contact section 11 for receiving a mating terminal (not shown) and a crimp section 12 for crimping a wire. At a rear end of the crimp section 12 is a carrier section 13, which is used during a manufacturing process.

Figure 2:
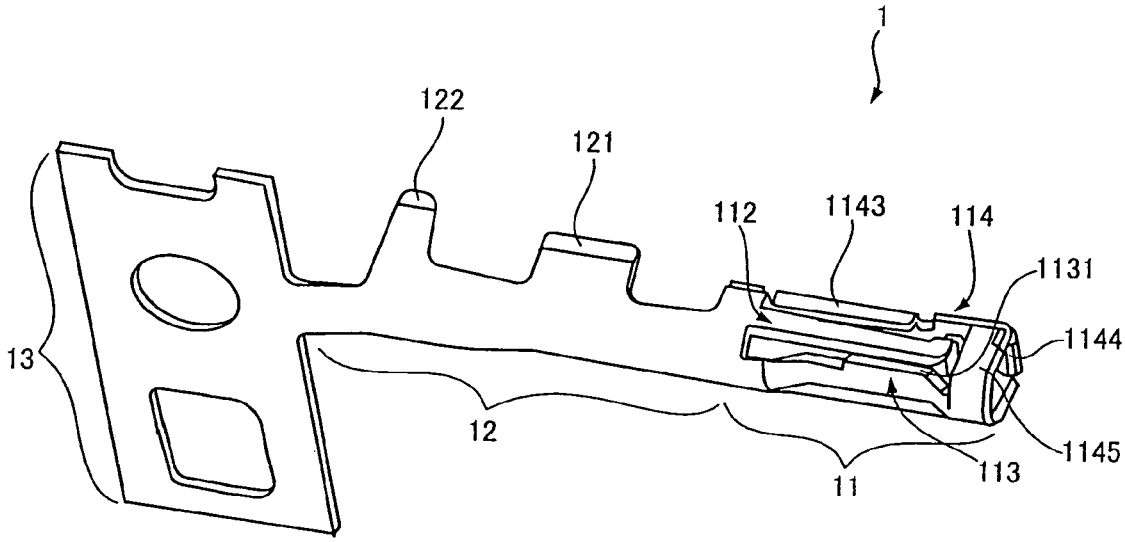
FIG. 2 is a perspective view from below of the receptacle terminal of FIG. 1.
Figure 3A:
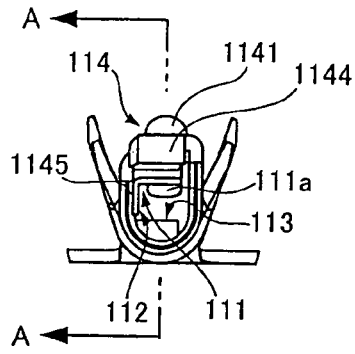
FIG. 3A is a front view of the receptacle terminal of FIG. 1.
Figure 4A:
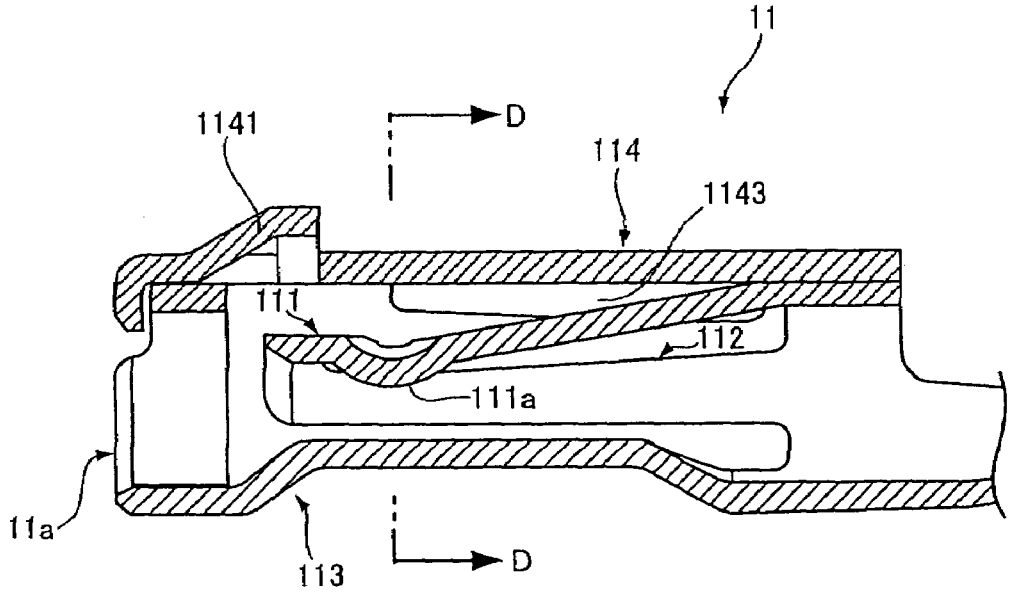
FIG. 4A is a sectional view taken along line A-A of FIG. 3A.
Figure 4B:
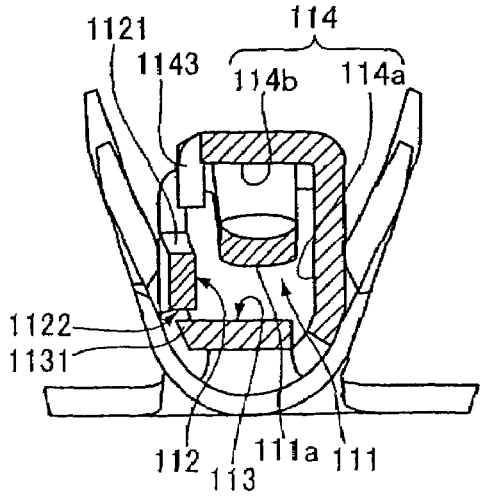
FIG. 4B is a sectional view taken along line D-D of FIG. 3A.

As shown in FIG. 1, the contact section 11 has a substantially rectangular shape. A terminal receiving opening 11*a* extends through the contact section 11. As shown in FIGS. 2 and 4A, the contact section 11 comprises a contact arm 111, a link arm 112, a first protection member 113, and a second protection member 114. As shown in FIG. 4B, the link arm 112 includes a first edge 1121 that extends along a mating direction of the mating terminal (not shown) and a second edge 1122 formed on a side opposite from the first edge 1121. The first protection member 113 includes a first link arm protection member 1131. The second protection member 114 includes a substantially U-shaped section 1145 that forms the terminal receiving opening 11*a*, as shown in FIG. 3A. The second protection member 114 includes a first surface 114*a* and a second surface 114*b*. The second protection member 114 includes a second link arm protection member 1143 formed from a bent section 1143 of the second protection member 114. The second link arm protection member 1143 is bent toward the first edge 1121 of the link arm 112, as shown in FIG. 4B. A space is formed between the first edge 1121 and the second link arm protection member 1143 and the second edge 1122 and the first link arm protection member 1131.

As shown in FIG. 3A, a tip end portion of the contact arm 111 is connected to the link arm 112 such that the contact arm 111 and the link arm 112 form a substantially L-shaped contact spring. As shown in FIG. 4A, the contact arm 111 includes a contact member 111*a* for contacting the mating terminal (not shown). As shown in FIG. 2 and FIG. 4A, a portion of the first protection member 113, which opposes the contact member 111*a* provided on the contact arm 111, is raised to press the mating terminal (not shown) against the contact member 111*a*.

The first protection member 113 opposes the contact arm 111 on a side of the link arm 112 to protect the contact spring. The first surface 114*a* of the second protection member 114 opposes the link arm 112 at a side of the contact arm 111 to protect the contact spring. The second surface 114*b* of the second protection member 114 opposes the first protection member 113 so that an area above the contact arm 111 is covered by the second surface 114*b* of the second protection member 114. The contact arm 111 is arranged between the first protection member 113 and the second surface 114*b* to protect the contact spring.

Figure 3B:
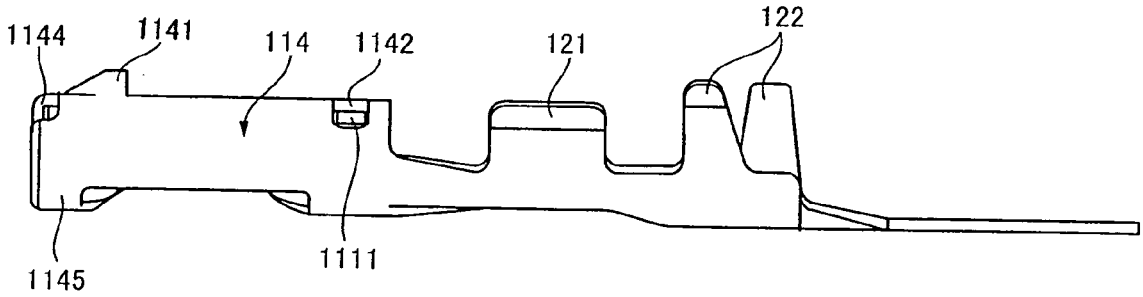
FIG. 3B is a side view of the receptacle terminal of FIG. 1.

As shown in FIGS. 1 and 3B, a top surface of the contact section 11 includes a locking member 1141, a bore 1142, and a guide section 1144 for guiding the mating terminal (not shown) into the terminal receiving opening 11*a*. The locking member 1141 may be formed by cutting and raising the second surface 114*b* of the second protection member 114 away from the contact arm 111 so that even if the thickness of the second surface 114*b* of the second protection member 114 is small, a necessary engagement margin can be ensured between the second protection member 114 and a housing lance (not shown) of a mating connector housing (not shown). A projection 1111, which determines the position of the contact arm 111 at the side of the crimp section 12, is fitted into the bore 1142 and is provided in a border of the first surface 114*a* and the second surface 114*b* of the second protection member 114.

As shown in FIG. 1, the crimp section 12 comprises a wire retaining barrel 121 and an insulation retaining barrel 122. The wire retaining barrel 121 is formed to secure a core of the wire when crimped. The insulation retaining barrel 122 is formed to secure an insulated portion of the wire when crimped. Because the crimp section 12 and the carrier section 13 are well known in the art, the crimp section 12 and the carrier section 13 will not be described in greater detail herein.

The receptacle terminal 1 may be formed, for example, by stamping and forming a metal plate. The receptacle terminal 1 may be formed by bending a metal plate to a substantially rectangular shape while enfolding a portion corresponding to the contact arm 111 at an end portion of the metal plate inside. After stamping the metal plate, the contact arm 111 is further bent to incline toward the terminal receiving opening 11*a* from a back side of the contact section 11.

In the receptacle terminal 1 according to the first embodiment, the first protection member 113 and the first surface 114*a* of the second protection member 114 perform the function of the first and second contact springs of the prior art. The contact arm 111 provided with the contact member 111*a* is protected by the second surface 114*b* of the second protection member 114. Further, the link arm 112 is protected with respect to the mating direction by the first edge 1121 and the bent section 1143 and the second edge 1122 and by the first link arm protection member 1131. As a result, the contact spring is protected and necessary contact pressure can be ensured between the receptacle terminal 1 and the mating terminal (not shown), while the external size of the receptacle terminal 1 remains small.

FIGS. 5A-6E show a receptacle terminal 2 according to a second embodiment of the invention. Elements of the receptacle terminal 2 that are similar to elements of the receptacle terminal 1 of the first embodiment will be described using the same reference numerals.

Figure 5A:
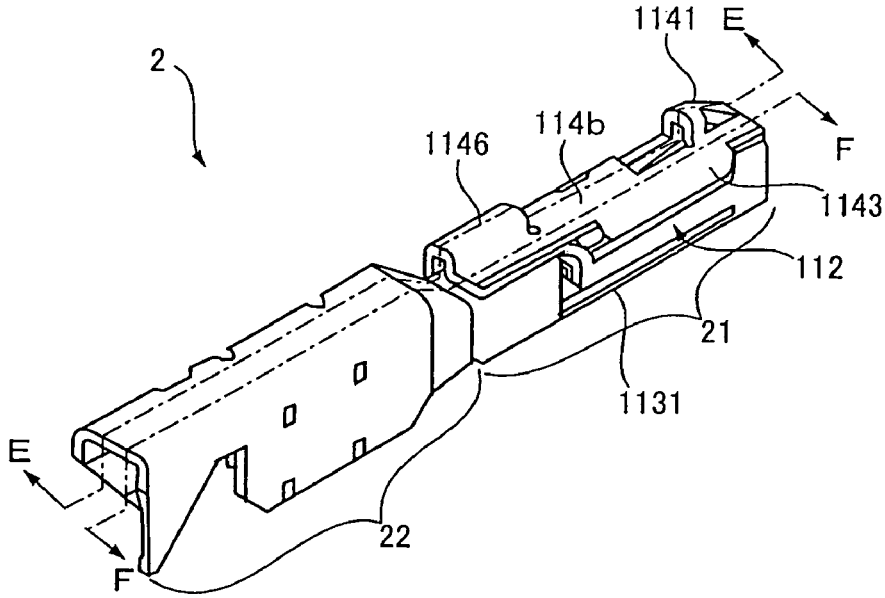
FIG. 5A is a perspective view from above of a second embodiment of a receptacle terminal according to the invention.
Figure 6A:
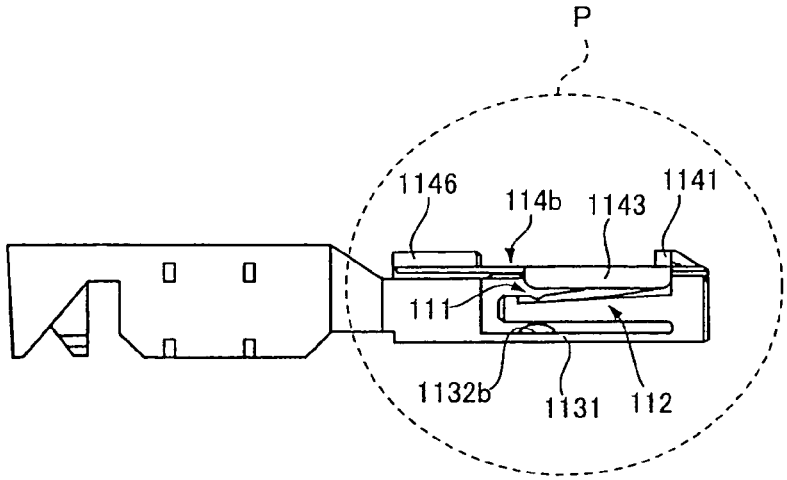
FIG. 6A is a first side view of the receptacle terminal of FIG. 5A.
Figure 6B:
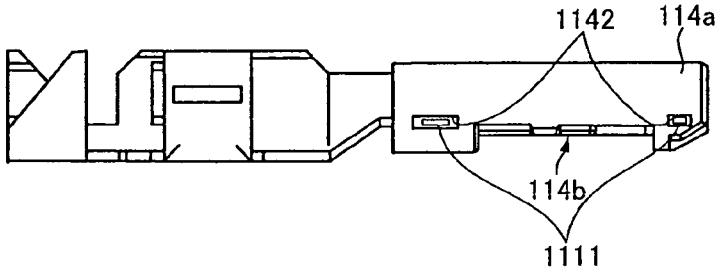
FIG. 6B is a second side view of the receptacle terminal of FIG. 5A.
Figure 6C:
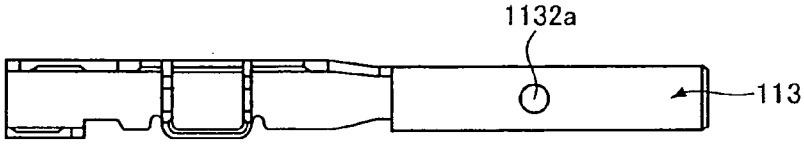
FIG. 6C is a bottom view of the receptacle terminal of FIG. 5A.
Figure 6D:
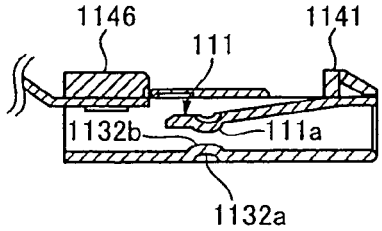
FIG. 6D is a partial sectional view taken along line E-E of FIG. 5A.
Figure 6E:
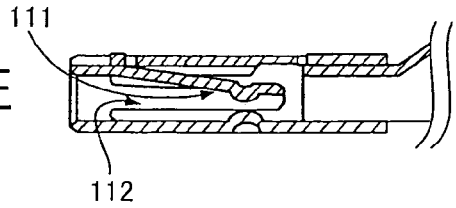
FIG. 6E is a partial sectional view taken along line F-F of FIG. 5A.

As shown in FIG. 5A, the receptacle terminal 2 comprises a contact section 21 for receiving a mating terminal (not shown) and a crimp section 22 for crimping a wire. Unlike the first embodiment, where the contact arm 111 inclines downward into the terminal receiving opening 11*a* from a rear side of the contact section 11, in the second embodiment, a contact arm 111 inclines downward from a front side of the contact section 21 toward a back side of the contact section 21 into the terminal receiving opening 11*a*, as shown in FIG. 6D. The contact arm 111 includes a contact member 111*a*. As shown in FIG. 6A, the contact arm 111 and a link arm 112 form a contact spring.

Figure 5B:
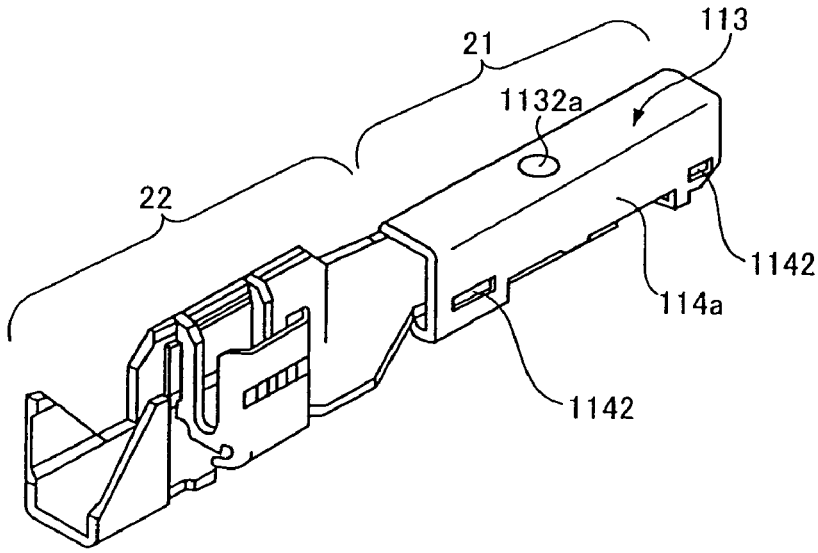
FIG. 5B is a perspective view from below of the receptacle terminal of FIG. 5A.

As shown in FIG. 5A, a bent section 1143, which protects the link arm 112, is included at an end portion of a second surface 114*b* of a second protection member 114. A first link arm protection member 1131 is included on a first protection member 113. As shown in FIG. 5B, a first surface 114*a* of the first protection member 113 has a recess 1132*a* provided in a vicinity of an approximate center of the first protection member 113. As shown in FIG. 6B, on a border of the first and second surfaces 114*a*, 114*b* are bores 1142. The bores 1142 correspond to projections 1111 that position the contact arm 111.

As shown in FIG. 6D, a projection 1132*b* projects toward an opposite side from the first protection member 113 adjacent to the recess 1132*a*. The projection 1132*b* opposes the contact member 111*a* so that contact with the mating terminal (not shown) which is fitted into the contact section 21 is made more reliable by the projection 1132*b*. The projection 1132*b*, which acts as a contact member with the mating terminal (not shown), is provided on a side of the crimp section 22 and therefore, as compared with the receptacle terminal 1 of the first embodiment where the contact member 111*a* is provided on a side of the terminal receiving opening 11*a*, lower insertion of the mating terminal (not shown) is realized. Because the crimp section 22 is well known in the art, the crimp section 22 will not be described in greater detail herein.

As shown in FIG. 5A, a top surface of the contact section 21 includes a locking member 1141 and an engagement member 1146. The engagement member 1146 is disposed behind the locking member 1141 and in line therewith. The locking member 1141 and the engagement member 1146 are formed in a second surface 114*b* of the second protection member 114. The locking member 1141 may be formed, for example, by being cut and raised away from the contact arm 111. Thus, even if the thickness of the second surface 114*b* of the second protection member 114 is small, a necessary engagement margin can be ensured between the receptacle terminal 2 and a housing lance (not shown) of a connector housing (not shown). Further, the locking member 1141 and the engagement member 1146 are longitudinally arranged in a line and are eccentrically formed so that reverse insertion can be prevented.

According to the receptacle terminal 2 of the second embodiment, the contact spring can be protected and necessary contact pressure can be ensured between the receptacle terminal 2 and the mating terminal (not shown) while the external size of the receptacle terminal 2 is kept small. Further, the bent section 1143 and the first link arm protection member 1131 can protect the link arm 112 with respect to the mating direction.

Figure 7:
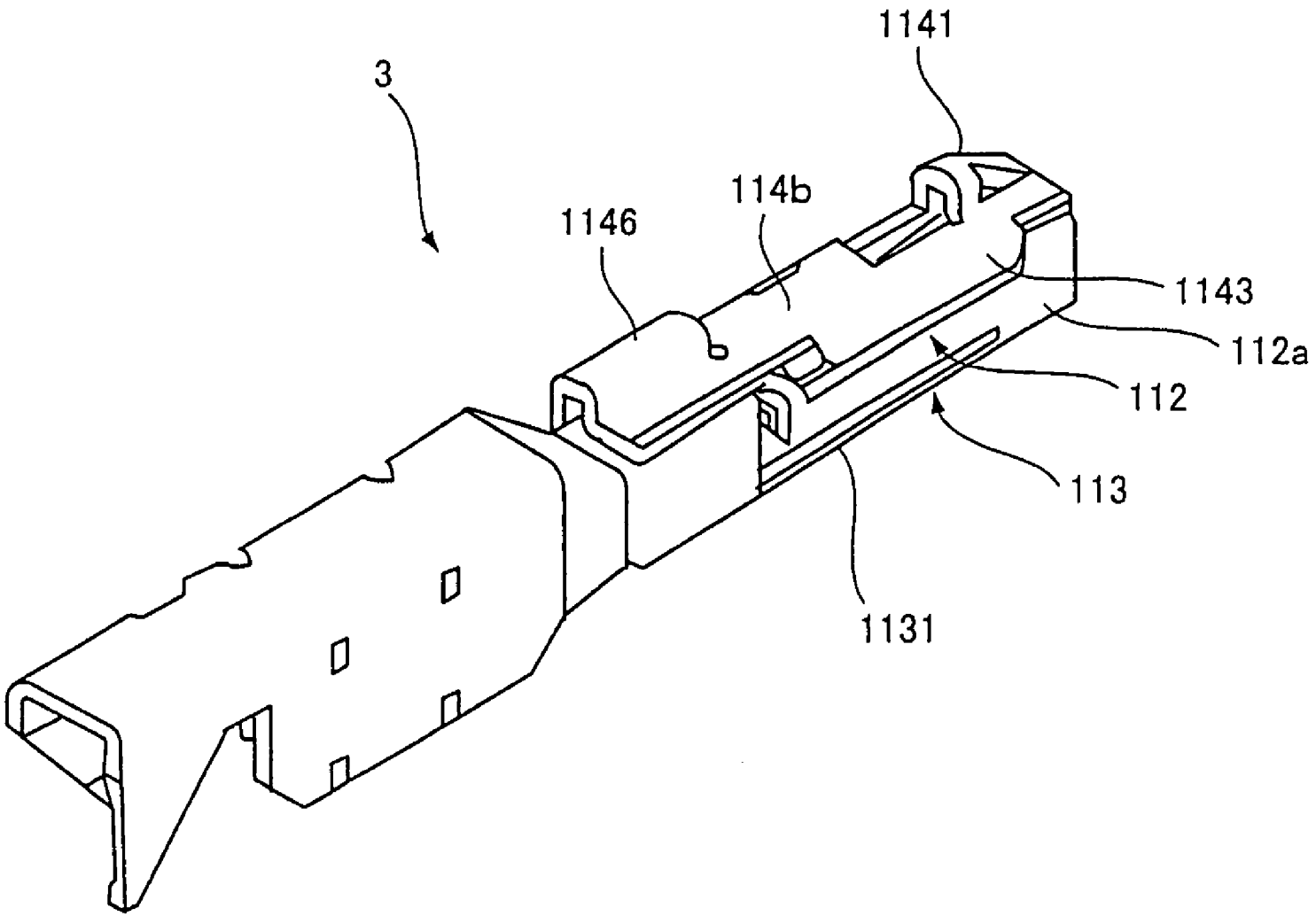
FIG. 7 is a perspective view from above of a third embodiment of a receptacle terminal according to the invention.
Figure 8:
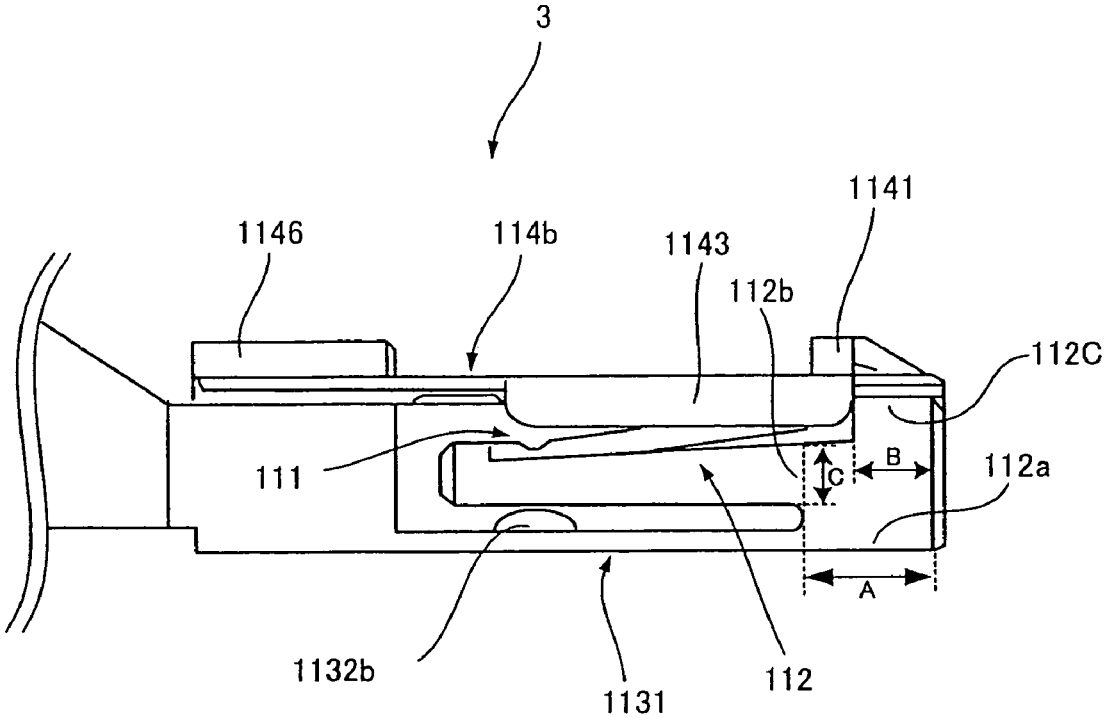
FIG. 8 is a partial side view of the receptacle connector of FIG. 7 corresponding to dotted section P is FIG. 6A.

FIGS. 7-8 show a receptacle terminal 3 according to a third embodiment of the invention. Elements of the receptacle terminal 3 that are similar to elements of the receptacle terminal 1 of the first embodiment and the receptacle terminal 2 of the second embodiment will be described using the same reference numerals.

In the third embodiment, a first bent section 112*a*, which is a point of support when the link arm 112 moves in an up and down direction with respect to FIG. 8, is formed between a link arm 112 and a first protection member 113. The first bent section 112*a* has a length A. A base 112*b* of the link arm 112 has a width C. A second bent section 112*c* on a second surface 114*b* side of a second protection member 114 has a length B. The ratio of the dimensions A, B and C is 18:12:7.

The length A of the first bent section 112*a* in the third embodiment is longer than the length B of the second bent section 112*b*, as compared to the receptacle terminal 2 of the second embodiment. Because the dimension of the first bent section 112*a* is made longer without changing the dimension of the second bent section 112*c*, the contact pressure between the contact member 111*a* and the mating terminal (not shown) is made higher than the receptacle terminals 1, 2 of the first and second embodiments without increasing the external size of the receptacle terminal 3. Therefore, proper contact pressure is obtained while miniaturization of the receptacle terminal 3 is realized. Additionally, because a projection 1132*b* which contacts the mating terminal (not shown) is provided on a side of the crimp section 22, similar to the receptacle terminal 2 of the second embodiment, lower insertion of the mating terminal (not shown) can be realized.

Although the receptacle terminals 1, 2, 3 described herein are illustrated as having the bent section 1143 at the end portion of the second surface 114*b* of the second protection member 114, the first link arm protection member 1131 on the first protection member 113, and the locking member 1141, it will be appreciated by those skilled in the art that the effect of the present invention is not altered by the elimination of some or all of these elements.

We claim:

1. A contact section for a receptacle terminal, comprising:

a substantially L-shaped contact spring including a link arm and a contact arm, the link arm having a first edge and a second edge opposite the first edge, the first edge extending in a mating direction of a mating terminal, the contact arm extending along the first edge and having a tip end portion connected to the first edge, the contact arm including a contact member for contacting the mating terminal;

a first protection member having a first link arm protection member positioned next to and opposing the second edge, the second edge engaging the first link arm protection member when the link arm is displaced toward the first protection member to restrict movement thereof;

a second protection member having a second link arm protection member positioned next to and opposing the first edge, the first edge engaging the second link arm protection member when the link arm is displaced toward the second protection member to restrict movement thereof; and the link arm, the first protection member, and the second protection member defining an external surface of the contact section, the contact arm being disposed inside the external surface of the contact section and enclosed thereby.

2. The contact section of claim 1, wherein the contact section is formed from a single metal plate.

3. The contact section of claim 1, wherein the second protection member is substantially U-shaped.

4. The contact section of claim 1, wherein the first protection member includes a projection opposing the contact member.

5. The contact section of claim 1, wherein the first protection member, the link arm, and the second protection member define a terminal receiving opening, the contact arm extending into the terminal receiving opening.

6. The contact section of claim 1, wherein the first edge is spaced from the second link arm protection member and the second edge is spaced from the first link arm protection member.

7. The contact section of claim 1, wherein the external surface of the contact section has a substantially rectangular shape.

8. The contact section of claim 1, wherein the second protection member includes a locking member.

9. The contact section of claim 8, wherein the second protection member includes an engagement member formed adjacent to the locking member.

10. A receptacle terminal, comprising:

a crimp section; and a contact section including a substantially L-shaped contact spring, a first protection member, and a second protection member, the contact spring including a link arm and a contact arm, the link arm having a first edge and a second edge opposite the first edge, the first edge extending in a mating direction of a mating terminal, the contact arm extending along the first edge and having a tip end portion connected to the first edge, the first protection member having a first link arm protection member positioned next to and opposing the second edge, the second protection member having a second link arm protection member positioned next to and opposing the first edge, the second edge engaging the first link arm protection member when the link arm is displaced toward the first protection member and the first edge engaging the second link arm protection member when the link arm is displaced toward the second protection member to restrict movement thereof, the link arm, the first protection member, and the second protection member defining an external surface of the contact section, the contact arm being disposed inside the external surface of the contact section and enclosed thereby.

11. The receptacle terminal of claim 10, wherein the receptacle terminal is formed from a single metal plate.

12. The receptacle terminal of claim 10, wherein the second protection member is substantially U-shaped.

13. The receptacle terminal of claim 10, wherein the first protection member includes a projection opposing the contact arm.

14. The receptacle terminal of claim 10, wherein the contact arm includes a contact member for contacting the mating terminal.

15. The receptacle terminal of claim 10, wherein the first protection member, the link arm, and the second protection member define a terminal receiving opening, the contact arm extending into the terminal receiving opening.

16. The receptacle terminal of claim 10, wherein the first edge is spaced from the second link arm protection member and the second edge is spaced from the first link arm protection member.

17. The receptacle terminal of claim 10, further comprising a carrier section.

18. The receptacle terminal of claim 10, wherein the external surface of the contact section has a substantially rectangular shape.

19. The receptacle terminal of claim 10, wherein the second protection member includes a locking member.

20. The receptacle terminal of claim 19, wherein the second protection member includes an engagement member formed adjacent to the locking member.

* * * * *

UNITED STATES PATENT AND TRADEMARK OFFICE

CERTIFICATE OF CORRECTION

PATENT NO. : 7,351,122 B2
APPLICATION NO. : 11/180748
DATED : April 1, 2008
INVENTOR(S) : Suemitsu et al.

It is certified that error appears in the above-identified patent and that said Letters Patent is hereby corrected as shown below:

On the cover page, item [73] add Assignee, -- Tyco Electronics AMP K.K., Kanagawa-ken (JP) --

Signed and Sealed this

Eighteenth Day of November, 2008

JON W. DUDAS
*Director of the United States Patent and Trademark Office*